US011024128B2

(12) United States Patent
Pececnik et al.

(10) Patent No.: US 11,024,128 B2
(45) Date of Patent: Jun. 1, 2021

(54) DROP ELEMENT GAMING SYSTEMS, APPARATUS, METHODS AND GAMES

(71) Applicant: INTERBLOCK D.D., Menges (SI)

(72) Inventors: Joze Pececnik, Smarca (SI); Jamie Abrahamson, Las Vegas, NV (US)

(73) Assignee: INTERBLOCK D.D., Menges (SI)

( * ) Notice: Subject to any disclaimer, the term of this patent is extended or adjusted under 35 U.S.C. 154(b) by 433 days.

(21) Appl. No.: 13/743,266

(22) Filed: Jan. 16, 2013

(65) Prior Publication Data

US 2014/0038680 A1 Feb. 6, 2014

Related U.S. Application Data

(60) Provisional application No. 61/586,984, filed on Jan. 16, 2012.

(51) Int. Cl.
*G07F 17/32* (2006.01)
*G07F 17/34* (2006.01)

(52) U.S. Cl.
CPC ..... *G07F 17/3293* (2013.01); *G07F 17/322* (2013.01); *G07F 17/3213* (2013.01); *G07F 17/34* (2013.01)

(58) Field of Classification Search
CPC ..... G07F 17/3206; G07F 17/3293; G07F 17/3213; G07F 17/322; G07F 17/34
See application file for complete search history.

(56) References Cited

U.S. PATENT DOCUMENTS 4,312,511 A 1/1982 Jullien
4,775,155 A 10/1988 Lees
5,380,007 A * 1/1995 Travis et al. ..... 463/18
5,622,367 A 4/1997 Hwang
5,743,526 A 4/1998 Inoue
7,247,094 B2 7/2007 Hosaka
7,316,610 B2 1/2008 Seelig
7,396,031 B2 7/2008 Huynh
7,413,511 B2 8/2008 Seelig
7,547,018 B2 6/2009 Lin
7,959,152 B2 6/2011 Seelig
2004/0048659 A1* 3/2004 Seelig ..... G07F 17/3267 463/25
2004/0072611 A1* 4/2004 Wolf et al. ..... 463/20
2005/0037831 A1 2/2005 Seelig
(Continued)

*Primary Examiner* — Kang Hu
*Assistant Examiner* — Thomas H Henry
(74) *Attorney, Agent, or Firm* — BakerHostetler

(57) ABSTRACT

Wagering games, bonus games, secondary games and/or progressive games can be enabled on a gaming system having:

a set of gaming elements having a readable indicia thereon or a sensing system indicating the presence of a gaming element at a specific location and the generation of a gaming value for a sensed gaming element;

a motivating system for physically moving and distributing random individual gaming elements from a set of gaming elements to individual positions within a receptor element;

a sensing system configured to sense information on individual gaming elements, the information relating to at least one of game values or symbols;

wherein the sensing system is in data communication connectivity with a processor and the processor is configured to determine a specific game value related to a basis for determining a game outcome.

21 Claims, 8 Drawing Sheets

(56) References Cited

U.S. PATENT DOCUMENTS

| | | | | |
|---|---|---|---|---|
| 2005/0075157 | A1 | 4/2005 | Seelig | |
| 2005/0098944 | A1* | 5/2005 | Brandstetter | 273/144 A |
| 2005/0261047 | A1 | 11/2005 | Fiden | |
| 2006/0003836 | A1 | 1/2006 | Seelig | |
| 2006/0178203 | A1* | 8/2006 | Hughes | G07F 17/32 463/20 |
| 2006/0217169 | A1 | 9/2006 | Manber | |
| 2008/0227519 | A1 | 9/2008 | Jackson | |
| 2008/0274792 | A1* | 11/2008 | Walker et al. | 463/25 |
| 2009/0061981 | A1 | 3/2009 | Smith | |
| 2009/0121433 | A1* | 5/2009 | Snow | A63F 1/00 273/292 |
| 2011/0003635 | A1 | 1/2011 | Uchiyama | |
| 2011/0212759 | A1 | 9/2011 | Gail | |
| 2011/0287823 | A1 | 11/2011 | Guinn | |
| 2011/0306406 | A1 | 12/2011 | Okuaki | |

* cited by examiner

↓

215 220

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |

↓ 225 230

235 240

| | |
|---|---|
| PLAYER 1 | A♠ A♣ K♥ K♣ 7♣ |
| PLAYER 2 | K♥ Q♣ J♦ 10♦ 9♥ |
| PLAYER 3 | 10♦ 9♦ 7♦ 4♦ 2♦ |
| PLAYER 4 | Q♣ Q♠ 6♠ 3♠ 2♥ |
| PLAYER 5 | K♥ J♥ 9♦ 6♦ 4♠ |
| PLAYER 6 | 7♠ 7♣ 7♥ 7♦ 3♦ |

Fig. 2A

220

| | | | | | | | | | |
|---|---|---|---|---|---|---|---|---|---|
| 1A | 2A | 3A | 4A | 5A | 6A | 7A | 8A | 9A | 10A |
| 11A | 12A | 13A | 14A | 15A | 16A | 17A | 18A | 19A | 20A |
| 21A | 22A | 23A | 24A | 25A | 26A | 27A | 28A | 29A | 30A |
| 31A | 32A | 33A | 34A | 35A | 36A | 37A | 38A | 39A | 40A |
| 41A | 42A | 43A | 44A | 45A | 46A | 47A | 48A | 49A | 50A |
| 51A | 52A | 53A | 54A | 55A | 56A | 57A | 58A | 59A | 60A |

Fig. 2B

221a

| | | | | | | | | | |
|---|---|---|---|---|---|---|---|---|---|
| 1A | 2A | 3A | 4A | 5A | 6A | 7A | 8A | 9A | 10A |

221b

| | | | | | | | | | |
|---|---|---|---|---|---|---|---|---|---|
| 11A | 12A | 13A | 14A | 15A | 16A | 17A | 18A | 19A | 20A |

221c

| | | | | | | | | | |
|---|---|---|---|---|---|---|---|---|---|
| 21A | 22A | 23A | 24A | 25A | 26A | 27A | 28A | 29A | 30A |

221d

| | | | | | | | | | |
|---|---|---|---|---|---|---|---|---|---|
| 31A | 32A | 33A | 34A | 35A | 36A | 37A | 38A | 39A | 40A |

221e

| | | | | | | | | | |
|---|---|---|---|---|---|---|---|---|---|
| 41A | 42A | 43A | 44A | 45A | 46A | 47A | 48A | 49A | 50A |

221f

| | | | | | | | | | |
|---|---|---|---|---|---|---|---|---|---|
| 51A | 52A | 53A | 54A | 55A | 56A | 57A | 58A | 59A | 60A |

DROP ELEMENT GAMING SYSTEMS, APPARATUS, METHODS AND GAMES

RELATED APPLICATIONS DATA

This application is a Non-Provisional application claiming benefit of priority from Provisional U.S. Patent Application Ser. No. 61/586,984, filed Jan. 16, 2012.

BACKGROUND OF THE INVENTION

1. Field of the Invention

The present invention relates to the field of gaming systems, apparatus and methods. The invention described is particularly related to the field of technology in which virtual electronic or physical game balls or virtual game balls are used to assist in selecting individual symbol outcomes and in which collections of individual symbol outcomes may be used in providing a gaming event outcome. The technology described herein may include single game events, contemporaneous multiple game events, bonus game events, side bet wagers and progressive jackpot events.

2. Background of the Art

Gaming technology uses various physical or virtual representations to effect random outcomes. Playing cards, dice, ball drops, random symbol selections (physical or virtual) and the like represent some of the more common devices used to provide individual symbol outcomes and in many games, collections of individual symbol outcomes are collectively used to provide a random event outcome. Although a single die may be used to provide a single symbol outcome and an event outcome, the most popular casino dice game used two dice to collectively provide an event outcome in Craps. Many games using symbol selections (e.g., keno and bingo).

Game ball drop games are games in which a gaming element (e.g., usually a ball, but a chip or pointer may also be used) is used to provide a random symbol providing outcome. A candy wheel and pointer is a functional equivalent of a single symbol providing ball drop event. Other ball drops may also have single symbol provision winning outcomes (e.g., roulette) or provide multiple individual symbols that are used to create a final random gaming event outcome (e.g., keno or bingo). These games are well understood in the art.

The individual random symbol provision can be done in a number of ways. The candy wheel spins with variable speed and randomly stops at individual positions around the wheel. A roulette ball spins around a track on the side of a spinning wheel with slots, tracks or canoes that can stabilize the ball against movement. Each of the slots are numbered, and when the ball slows down and drops into a single slot, that number is the single symbol outcome and usually a final gaming event outcome. The balls have been provided by spinning balls on a plate and removing them randomly, one-at-a-time, having the balls stirred in a chamber or bowl and manually removing balls one-at-a-time, mixing and suspending balls in the air and withdrawing balls randomly one-at-a-time.

Certain ball drop mechanisms, such as the extraction of random balls from a circulating suspended set of balls in a chamber (which is referred to as a fluidized set of balls, referencing fluidized beds of particles as understood in the engineering arts) are well accepted by players in the gaming industry. One reason for the acceptance of such fluidized bed systems is the transparency of the system (confirming to players a lack of casino influence over ball selection) and the belief by players that physical games can be better estimated by players as to outcomes. Even though it is a long-standing mathematical and gaming principle that "dice have no memory," players tend to have an underlying belief that physical objects and events run in streaks, while electronic systems are truly random. These player beliefs are a main reason why physical systems predominate game play in games derived from older ball drop games, spinning wheel games and card games.

The gaming industry has not taken full advantage of player acceptance of the random symbol and random event generating physical system to provide game events different from those traditionally provided by those systems. That is, there have been few combinations of ball drop systems with poker games except where the ball drop positions are fixed card game outcomes. For example, pin-ball games and pin-ball drop ball games in the 1950's often included poker outcomes determined by drop or movement of the pin-balls through gates or into holes representing specific playing card values. These events included both skill contributions of the player in the machine manipulation and lack of substantive randomness, in part because of the player control of speed, intensity of bounce of balls and aim off flippers.

Various ball-drop systems known in the art for stand-alone, communal, or group games include, by way of non-limiting examples, Published U.S. Patent Application Document Nos. 20110306406; 20110287823; 20110003635; 20080227519 (including electronic, virtual ball drops); 20090061981 (including electronic, virtual ball drops); (including electronic systems and the like.).

Published U.S. Patent Application Document No. 20110212759 describes methods and devices for providing a first wagering game (such as a bingo game) that presents a changing pool of displayed game outcomes for a second wagering game (such as a Class III game), preferably on a network of gaming machines. Some implementations of the invention provide a bingo game that presents a changing pool of displayed game outcomes for a slot game or a poker game. In some preferred implementations, game outcomes are generated, e.g., by individual gaming machines, on an ongoing basis and stored in memory. Each of the game outcomes corresponds with a bingo outcome. Preferably, the game outcomes are sorted and stored according to payout amounts for various bingo outcomes. In some implementations, the game outcomes are stored in the form of random number generating ("RNG") seeds, but in other implementations the game outcomes are stored in a variety of other forms.

Gaming systems are known in the art to support games such as keno and bingo where a complete set of physical gaming elements (such as light-weight or hollow balls) are physically moved in a process where individual balls forming a subset of balls (often less than the complete set of physical gaming elements) are used to determine game outcomes. For example, in keno, where there may be (by way of non-limiting examples) 52 multiple balls, wagers may be accepted on matching 5, 6, 7, 8, 9, 10 (etc.) numbers out of 20 of the 52 numbers provided in an individual game event. Such provision of numbers (when provided by physical random ball selection rather than an electronic equivalent selection of virtual balls) has been provided by many variants of physical systems. Non-limiting examples of such physical and electronic systems are described in the following U.S. Published Patent Application Documents and U.S. patents, which are each incorporated by reference in their entireties: 20060217169; 20060003836; 20050261047;

20050098944; 20050075157; 20050037831; 7,959,152; 7,547,018; 7,413,511; 7,396,031; 7,316,610; 7,247,094; 5,743,526; 5,622,367; 4,775,155; and 4,312,511. There are also many commercially available systems that fluidize balls in chamber, remove random balls from the fluidized set of gaming balls and then deposit (and read) and or read the individually restrained balls or read subsets of restrained balls (e.g., balls restrained in transparent tubes) to provide individual symbol events (e.g., numbers or alphanumeric combinations as used in bingo) that are collectively used to determine game outcome events.

It is possible to use these games and systems as underlying games and as secondary games or as bonus or jackpot events.

SUMMARY OF THE INVENTION

Wagering games, bonus games, secondary games and/or progressive games can be enabled on a gaming system having:

- a set of gaming elements having a readable indicia thereon;
- a motivating system for physically moving and distributing random individual gaming elements from a set of gaming elements to individual positions within a receptor element;
- a sensing system configured to sense information on individual gaming elements, the information relating to at least one of game values or symbols;

wherein the sensing system is in data communication connectivity with a processor and the processor is configured to determine a specific game value related to a basis for determining a game outcome.

BRIEF DESCRIPTION OF THE FIGURES

FIG. 2A shows one example of a continuous frame gaming element acceptor system with an associated information sensing system.

FIG. 2B shows one example of a series of tube gaming element acceptors in a system with an associated information sensing system.

DETAILED DESCRIPTION OF THE INVENTION

Figure 1:
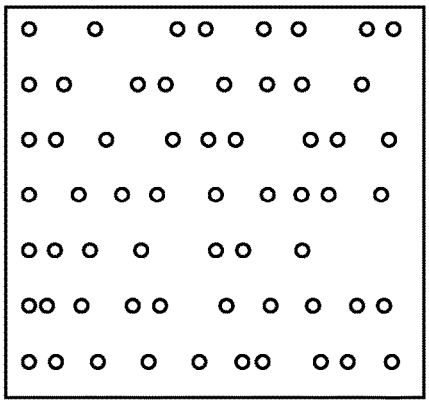
FIG. 1 shows a schematic of a gaming system according to technology described and enabled herein.

The presently described and enabled technology can be provided with many variations within the broad generic scope presented herein. The various systems can have various combinations of physical components, electronic components, mechanical components, electromechanical components and the like. Variations amongst size, shapes, numbers, order of events, game events, and the like are understood to be available and within the capabilities of the ordinarily skilled artisan. The following exemplary systems illustrate the practices within the generic scope of the invention, but are not intended to limit the scope of the claims or practice of the invention unless specific limitations are provided within claims.

A general description of the gaming systems enabled herein includes the following.

A gaming system may have:

a) a set of gaming elements having a readable indicia thereon or the gaming elements may be without specifically readable content. The gaming elements may be balls, blocks, cards, dice and the like (the read values, symbols, counts, rank/suit, position on a board, position in a series and the like are collectively referred to as "gaming values."). The gaming elements may have no visible markings (e.g., have no markings, be blank, have no visually or machine-readable markings, or have non-informational markings or colors) to provide primary information or may have markings that provide primary information. The gaming agents must have or be able to provide some secondary readable content as later described herein, even if that secondary readable content is merely optical opacity so that its presence can be sensed by optical sensors.

b) a motivating system or movement system for physically moving and allowing or enabling random distribution of individual gaming elements from among a set of gaming elements to individual positions (or individual positions) within a receptor element. The receptor element can have individual positions for individual gaming elements and/or collective positions for multiple gaming elements.

c) an automatic sensing system configured to sense information on opr the presence of individual gaming elements, the information relating to or activating the selection of at least one of game values, numbers, alphanumerics or symbols.

The sensing system is in data communication connectivity with a processor and the processor is configured to determine a specific game value related to a basis for determining a game outcome. The sensing system is "automatic" in that it is a mechanical, optical or electronic system that does not require direct human (visual reading) input to determine the sensed values, although human direction to activate the system at any particular time may be used with the system or not. For example, in a less preferred embodiment, once the gaming elements have been selected within the chosen subset, an operator may specifically request a sensing and reading of values to be effected as a security function or as an entertainment function), the actual sensing and symbols, value, count, number, alphanumerics or rank/suit determination may be done without human data entry. It is also possible for a human to enter the data from the indicia, but that would slow the operation of the game and require the presence of an operator on site or through electronic communication.

The individual gaming elements may have optically readable or electronically readable information thereon relating to the game value. The individual gaming elements may have optically readable information thereon and the sensing system is configured to read the optically readable information to provide sensed information and the sensor is configured to send sensed information to the processor. The individual gaming elements may have electronically readable information thereon and the sensing system is configured to read the electronically readable information to provide sensed information and the sensor is configured to send sensed information to the processor. The processor may be configured to execute code to recognize wagers on game outcomes determined by a subset of the gaming elements consisting of less than all the set of gaming elements, the processor configured to execute code on the sensed information from the subset of the gaming elements to determine gaming values, the processor being configured to resolve the wagers based on the gaming values determined by the processor. The processor may be configured to execute code to resolve wagers based on poker hand ranks based on the determined gaming values which comprise playing card rank and suit. The set of gaming element comprises physical game balls and the receptor element comprises a system that physically restrains the physical game balls. The receptor element may, by way of non-limiting example may be selected from the group consisting of tubes that hold the subset of gaming elements, holes in a substrate that support individual gaming elements that form the subset of gaming elements and passageways that transport individual gaming elements that form the subset of gaming elements. The stationary positions of a subset that is less than all of the set of gaming elements may be configured to determine a first game outcome selected from the group consisting of keno and bingo. An alternative electronic gaming system may have a processor, a player input system, a set of multiple physical gaming elements, a distribution and capture system for distributing physical gaming elements and a mechanical sensing system, wherein, at least some physical gaming elements having mechanically sensible indicia of playing card suit and rank thereon, and/or there is a presence sensing system that senses the gaming elements and initiates, causes or provides a random indication of a game value or generates a random game value (as through a random number generator or separate physical device), the capture system and physical gaming elements configured to provide data on a first game event that is not a playing card game; and the processor is configured to recognize wagers and the processor is configured to resolve wagers based on determined rank and suit of a subset of multiple gaming elements fewer in number than the set of multiple physical gaming elements.

A narrower, more specific range of gaming structure may have:

a set of gaming elements having playing card indicia thereon;

an air driving gaming element distribution system;

a sensing system that is configured to sense rank and suit of the playing card indicia;

wherein the sensing system is in data communication connectivity with a processor and the processor is configured to determine rank and suit of individual gaming elements a) after being distributed and becoming stationary and/or b) while being distributed and before becoming stationary. The gaming structure may further have an array of gaming element capture areas on which gaming elements can be distributed and be stabilized. The gaming structure may use gaming elements of balls that can be moved and distributed by the air driving gaming element distribution system and the gaming structure may further have an array of gaming element capture areas on which gaming elements can be distributed and be stabilized. For example, the gaming element capture areas may be support frames within which the balls can stably seat, such as where the support frames comprise circular holes. The processor may be configured to identify a rank of at least one card hand determined from rank and suit of distributed gaming elements. The indicia may be selected from alphanumerics, machine readable optical code, machine readable magnetic code, radiofrequency identification (RFID) and machine readable electronic code as non-limited examples. There may be at least 5 and up to 20, 30, 40, 50 60, 80 or more support frames and indicia on at least gaming elements are sensed and respective suits and rank are determined. The array of gaming element capture areas may have positions within transparent tubes. The sensing system may sense suit and rank on the gaming elements before they are stationary in the transparent tubes. The processor may be configured to recognize wagers and the processor is configured to resolve wagers based on determined rank and suit of multiple gaming elements.

The "play" of the underlying game may be described in various manners, with the type of equipment used to implement the game (mechanical gaming objects, virtual gaming objects, single game environment, multiple game environment and bonus game environment impacting the language used and the steps performed to effect the play event.

For example, in one simple form, there may be (by way of non-limiting examples) a complete set of balls (e.g., 52 balls, 53 balls with one representing a joker or bonus card or wild card, or 54 cards with two jokers, a joker and a bonus card or two wild cards, etc.). A wager is accepted by the system on a game outcome (e.g., 5-card poker hand) and on a specific number of balls in a first subset of the balls (less than the complete set, e.g., 4, 5, 6, 7, 8, 9, 10, 11, 12, etc. balls). A fixed number of balls (as a second subset of balls, greater than or equal in number to the first subset) is then distributed within the system. The indicia on the balls relating to playing cards (and events, such as a wild card or bonus card) is then sensed and interpreted as card rank for the number of the first subset wagered upon. The specific balls selected for reading may be based on the first and second subsets being equal in number, so that all balls in the second subset are read, the first number of balls equal to the number of balls in the first subset as they are being provided in the second subset, the reading of only balls filling of specific first subset number of locations (receptor, such as ball catches) and reading hand ranks provided by those only balls filling of specific first subset number of locations, and the like. If less than all balls are mechanically distributed, it is possible that all locations in the first subset may not provide any card value. If all balls are distributed and there are an equal number of receptors for the balls as the total number of balls, the total number of balls in the first subset will be used to determine a "best" poker hand. The following example will further explain the play of this first embodiment.

For simplicity, there will be 52 balls (each with indicia of each card in a standard playing card deck) and fifty-two (52) receptors. The receptors may be 52 depressions or holes in a surface that will catch individual balls, or 52 specific locations in receptor tubes that catch the balls (e.g., thirteen tubes with 4 balls each, four tubes with 13 balls each, etc.). The exemplary wager placed and accepted will identify a first subset of specific positions in the ball acceptor (e.g., 5 spaces from the fifty-two identified as positions 2, 8, 16, 32 and 48). All fifty-two balls are distributed and the playing card ranks for the five exemplary selected locations are sensed and determined. Those "playing cards" are then evaluated with respect to the wager, usually against a paytable (as is often done in a straight video poker game) or against other players at the table (e.g., with the wagers from all players forming a pot). If the poker hand rank is one listed on the paytable, a processor will award credits or indicate to a casino that an award is due to a specific player position. As further described herein, if the first subset number was five, the paytable odds may be quite similar to those for a five card stud (not draw) paytable and game. If the first subset was six balls and the game is five-card poker, the paytable odds would be less than for a first subset of 5 balls. Progressively, as the number of balls in the first subset increases, the paytable odds for a same five-card poker rank would decrease.

If the balls are also game balls for random drop in keno or bingo number/position identifiers, the position/number wagers may also include a poker wager, or a poker wager may be separately made. For example, a player may select (typically) 5-10 keno numbers, with balls dropping into keno number positions to select the keno numbers. (the numbers may be typically ordered in the receptors, such as 4 rows of thirteen numbers and one number to each position in order, or the numbers may be randomly assigned to the 4 rows of thirteen numbers at the beginning of each round (e.g., by a random number generator assigning numbers to each of the positions randomly so that the numbering of the positions may not be in order, but may itself be random for each game). The player may play only keno, with no impact from poker outcomes, there may be a bonus awarded with or without an additional wager, or the player may play only poker and not the underlying keno game. The poker aspect may be played as a bonus game also. Where a player has a specific level or type of success in the underlying (e.g., poker or bingo) game, specific events in the underlying game (such as 5/5 numbers in the first subset hit, 6/7 first subset of numbers hit, 8/10 of the first subset of numbers hit) can trigger an automatic poker bonus, with a paytable activated and payouts being according to the payout for poker hands in the event with successful balls from the first subset, or there being absolute payouts for certain hands (e.g., always $50.00 for any straight flush or higher, without regard to how many numbers wagered in the first subset). The automatic bonus event may also be a progressive jackpot, which might require a specific level of participation by wagering positions in the underlying game. For example, there may be an automatic individual game entry in a progressive jackpot where the wager accepted at a machine would be a maximum wager on at least a first subset of cards. Entry may also be based upon a history of maximum or substantial wagers at a gaming position. A portion of all players wagers, or all maximum wagers may contribute to the progressive jackpot. The jackpot may also be available for only the minimum number of balls in the subset (e.g., where only five numbers/positions are selected as the first subset) or only if the winning outcome (e.g., the royal flush) only where all numbers/positions in the subset are in play by the outcome of ball positions where the second subset is less than the complete set. For example, the progressive jackpot might be paid for a royal flush where 8/8 first subset numbers/positions are secured by ball drops, and not paid (in whole, although part, such as 10%, might be paid) where the player position has a royal flush but only 5/8 first subset numbers/positions were selected by ball drops.

Electronic equivalents of these events, using random number generator systems to implement the randomness and the drop selections or outcome selections of gaming element selection (other than by typical dealing of actual playing cards or virtual playing cards) could be easily implemented once this invention has been understood.

Underlying Mechanical Technology

A mechanical system randomly selects from a first set of physical balls. The balls are individually marked with at least one specific identifying data content. The terms "mark(s)," "marking(s)" or "marked" encompasses all types of readable identifying content including, but not limited to, optically readable (including alphanumerics and/or symbols and the like), mechanically readable (including alphanumerics, symbols and the like, bar code, radio frequency identification (RFID) and any other readable format. The markings contain information relating to an identifier (e.g., an identifying value) distinct from other balls (preferably each and every other ball). That value is associated (by direct reading or through comparison (manually or electronically) in a look-up table or schedule in a processor. The balls may be used (or not) in an underlying game where the balls land in a system or receptors where there is a first information reading (e.g., a) tubes where a specific number of balls are received and read; b) drop zones where individual balls are collected; c) reading zones where individual balls are read on the fly; and/or d) reading zones where individual balls or groups of balls are separated or segregated from or with balls) and the first read information is used in a first game (or there is no first game).

If a first underlying game is bingo or keno (or other game in which balls with first identifiers are randomly provided to provide data in which subsets of the entire set of balls and markings are used to determine an outcome in a gaming event. The balls may be first used in the underlying game, which can be and should be independent of a second game in which secondary data or second read data I used. By "secondary data" is meant that the first read data is subsequently correlated with a fixed or changeable identifying value. For example, one ball out of a set of (for example) fifty-two (52) balls my have a first readable data value of (by way of non-limiting examples) one (1)-fifty-two (52), a (letter a), B-1 through O-52 (as a bingo value), Ace of clubs-King of Spades (a full standard deck of playing cards) or any other set of first values. The first readable value may be used to determine a second (e.g., secondary value) through a look-up table. The look-up table may be physical and fixed or electronic and fixed or variable. A variable table could be constructed for each game event. The "construction" may be by a random selection of pre-existing look-up tables or by random number generators constructing look-up table with individual first values being correlated to individual second values. For example, there could be 52 factorial pre-constructed look-up tables with one-to-one first and second value correlations, or for each game, a random number generator may form a look-up table with fifty-two, one-to-one first value and second value correlations. If there is a nominal (an identifier have no first game value) value or identifier on each ball (e.g., 1-52), when each ball is received in the play of the underlying game (e.g., keno or bingo), as each ball becomes active, that individual first ball (and/or identifying data) is used to identify secondary or second read data. For example, if the first nominal identifier/value for a ball was read as number 1, a first look-up table may correlate that number 1 with an Ace of Spades. If any other one of the pre-constructed look-up tables is used, that nominal value/identifier 1 may be any other playing card in the deck, such as the seven of clubs. All fifty-two nominal values/identifiers will have a corresponding playing card value. The use of this random correspondence can, by way of non-limiting examples, be used to the following ends:

If five first identifiers/values are used in a 5-number keno selection, the first nominal (or real) keno values are then used to identify specific playing cards for a second game (actual second game, secondary game, bonus game, side-bet game, or the like) to determine a five-card (or fewer card, such as four-card, three-card, two-card or high-card or low card) rank. The balls themselves may have the secondary values directly associated with the individual balls and the secondary game resolved in a slightly different but related manner.

By way of another non-limiting example, there may be fifty-two receptors which provide the set of fifty-two identifying receptors (either random or pre-identified). For example, there may be fifty-two holes numbered 1-52, or fifty-two holes that are randomly assigned first identifiers in the first game (or just nominally). For example, in the play of keno there may be a first set of fifty-two numbers used. A player typically may wager on a set of numbers (e.g., 5, 6, 7, 8, 9 or 10 numbers) in an underlying keno game. There may be a side bet or second bet on a (for example) five-card poker rank. If there was a five-number keno wager, the balls in the five number positions selected by the player, if they are active numbers (numbers that were provided in the provision of the (for example) twenty number selections made in the play of keno), are used to identify a poker hand (five card high, low ball, etc.). The rank of the five-card poker game can be used against a paytable in a side game, secondary game, bonus game or the like as is typically done when actual playing cards are used in gaming systems. If the initial keno (or other game) wager were for six (or more) cards, the first five numbers that are chosen by the first identifier/valuator, the first five active numbers or the like may be the basis of the secondary wager resolution. A different payout table with a different payment schedule may be used for the same five-card poker ranks, because of the larger number of "cards" that may be used to form the five-card poker rank. For example, a typical pay-scale for five-card poker games with five-card stud games or five card draw games for a royal flush could be 500:1 for five-card stud and 1000:1. In a six-number wager in keno, if all six active numbers receive cards, the pay-scale for a royal flush would be adjusted down from five card hands (for example) to 500:1 or less. With seven active numbers in Keno, the pay-scale would be adjusted downward (for example) to 100:1 or less. As increasing numbers are selected in (for example) keno, the pay-scale will continue to diminish for the same (five-card) poker rank. In this manner, the unique use of random numbers (random objects with unique second valuations/identifiers) are used in a secondary game.

Although the description has emphasized balls, bingo and keno, other variations may be used. For example, as the physical objects, may be two, three or more dice that are physically (or virtually) rolled to determine an event outcome, and that event outcome is then used to select a game outcome or individual symbol outcome. For example, two dice may be of a first color and a third die may be of a different and distinct color (as in (Sic Bo). The two, same color dice provide thirty-six (36) outcomes. The third distinct color die can be used to provide as many as a total of 216 outcomes (36×6). The third die may actually be used to provide any number of outcomes between 36 and 216. If the third die is ignored, there are thirty six outcomes. If the third die is considered in outcomes with only specific combinations of the two die, any number of outcomes between 36 and 216 may be found. For example, if the two die are 6 and 6 (a count of twelve, which occurs with only one combination of the two dice), a $37^{th}$ outcome may occur (for example) only when the third die is another 6. By selecting various combinations of two die event outcomes and third die event outcomes, any number of event outcomes between 36 and 216 may be provided. For example, if fifty-two playing cards are being considered as event outcomes from a roll of the three dice, sixteen event combinations above the roll of the two dice must be added to the total of event outcomes available from the two dice. This could be effected by adding event outcomes (affected by the third die) to only the eight outcomes of 1-1, 1-2, 2-1, 3-1, 1-3, 2-2, 5-6, 6-5 and 6-6, where the presence of only a 1, 2 or 3 on the third die would have effects on those eight outcomes. This would effectively produce 16 additional event outcomes by adding twenty-four outcomes (the two dice combination and the third die, and removing eight event outcomes (1-1, 1-2, 2-1, 3-1, 1-3, 2-2, 5-6, 6-5 and 6-6, without consideration of the third die). In this manner, the physical (or virtual) three dice outcome can be repeatedly used in the apparatus to individually select playing cards. The three-dice outcomes may be used for an underling game (Sic Bo, Yahtzee, etc.) and the combinations of three dice may be individually and/or collectively used to select playing cards. Where 5 or six dice are used in the game (as in variants of Yahtzee), the different number (and different colors on each die or sets of dice) may be used to generate multiple playing cards with a single roll. For example, if there were six individual die, with six distinct colors (or other identifiers, even visually hidden identifiers) such as Red, Orange, Yellow, Green Blue and White, the color number combinations among 1-6 and the six colors could be used to determine playing cards. That is, with all six dice thrown, 1-Red, 1-White might be the Ace of Spades, independent of individual die outcomes of the other colors. A great many cards can be provided in a roll of six dice, as the combinations of an individual die may be used with the other five dice to effectively select playing cards. That is, even where 1-Red, 1-White might be the Ace of Spades, 1-Red, 3-Green might be the Jack of Diamonds and 1-White 3-Green might be the seven of Clubs. Playing cards could even be weighted in selection by using multiple dice combinations for the same card.

Underlying Electronic Technology

Commercial gaming systems may be converted to play of the game technology described herein. Such game systems include at least by computer hardware, software, or computer hardware and software. A most common form of computer implementation is a stand-alone, single player electronic gaming machine with electronic player controls and one or more video output screens. There has developed a wide range of technologies involving electronic components, wherein the systems are completely electronic or a blend of physical components and electronic components. The last would be where a physical table provides physical balls, and the outcomes are assessed or determined or captured by video cameras, sensors on the physical table and the like, and these outcomes are then registered or stored in a memory or computing system. Local or distal wagers are accepted through an electronic system and the game manager and accounting manager resolves the wagers according to the determined and recorded outcomes. These electronic or blended systems may be used in purely local environments with wagering at the table, locally dispersed environments such as access through casino/hotel provided equipment near the site, or widely dispersed through internet gaming access.

In any computer-based embodiment, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller" or "game controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master® gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, web-based gaming, PC practice play, hand-held game devices, wireless gaming devices and the like.

A mixed electronic and physical gaming system may also be constructed, with the physical balls having no readable information thereon, but the system is then still giving the illusion of specific playing card identification content on the individual balls. The playing card information provided can still be provided in an acceptable random and gaming certifiable and provable randomness. The randomness provided may even be of a more acceptable and provable level than would a physical random selection or drop ball system.

An underlying commercially available random number generation system with associated card suits and ranks may be purchased. This type of device, when activated or signaled will randomly select a number (weighted or not) from a selection of available numbers, and the available numbers are associated with specific playing cards (by rank and suit). For example, if a single deck of virtual playing cards (52 with no jokers or bonus cards) is provided by fifty-two random, indistinguishable game balls available for fifty-two receptor slots on the physical gaming system. The capture of a ball or the entrance of a ball into a receptor (as described herein) triggers the random number generator and any available virtual playing card is selected. By remaining card it is meant that as individual cards are removed from the virtual deck, there are fewer cards (the remaining identified card) available for selection. The triggering may be effected in a large number of ways.

The receptors (slots on a wheel, positions on a tube, holes on surface, square or geometrically shaped receiving frames, depressions, troughs or the like) can be associated with a sensor that identifies the presence or passage (past the sensor) of the game ball. The sensor provides the triggering system for the random number generator and the resultant selection of a specific playing card for each ball that is sensed for purposes of providing a playing card result. The sensor provides a signal through mechanical sensing (e.g., a trip wire, a trip toggle, a trip switch, a weight sensor), by optical sensors (e.g., infrared sensors, light interruption sensors, reflected light sensors, and the like), electronic sensors (e.g., RFID sensors, magnetic sensors, static sensors and the like) and any other system that can sense the presence or movement of a ball at a particular position.

Rather than the balls having or requiring a unique identifier that is associated with a playing card, the capture or positioning of the ball triggers the random number generator produces a resulting playing card. As an example is when a ball slides into a random drop slot (as in a roulette wheel), the ball is sensed and the random number generator provides data relating to a specific playing card. That specific playing card (identified to and/or by a processor) can then be displayed to players indicating the provision of that specific playing card to a particular slot or receptor, which may be a part of a wager (including a wager on a poker hand). One unique characteristic of this format is that the random number generation of playing cards is already industry accepted and approved in every gaming jurisdiction. The unique triggering device and random number generator combination provides a gaming system that has a high entertainment value, visual uniqueness and energetic system. There is an expectation as each of the playing cards is revealed as the balls enter the individual receptors.

The display of the playing card (rank and suit) can be provided in a number of ways. For example, each individual player may have a video monitor that shows the set of numbers (e.g., 1-52) and shows the numbers (first subset) selected by the wagers at the terminals, and then show corresponding playing card images for each number where a ball is captured and the random number generator provides a virtual random playing card which the processor is configured to provides signals and data for display. The numbers on the screen may be converted to display playing cards in each position. The system may differentiate playing cards associated with the first subset in a number of ways. As with keno hits, a unique color or image may be provided when the playing card is displayed on a first subset selected number for each player position terminal and monitor. The non-selected playing cards my be black-and-white, a different (less intense) color density and tone, the non-selected cards may be a smaller size than the selected number playing cards. There may also be a separate display area on the individual player monitors that shows collected selected arrays of an individual's playing cards and those cards may also be automatically arranged by the game processor to emphasize quality best player 5-card poker hands after all player number selections have been completed and even indicate potential best possible hands as individual player's position virtual cards are being provided. An example of play of the game is provided below to illustrate this game play format.

A gaming system is provided with a set of fifty-two lightweight (e.g., ping pong) balls. The balls are churned in air and circulated in a display. Individual balls are withdrawn from the set of balls and then individually distributed to and captured by a receptor. As the ball enters the receptor or as it is seated in the receptor, the ball passes over or blocks a sensor such as a proximity detector (e.g., U.S. Pat. No. 6,299,534) an optical detector (light emitter/receiver, transducer). Upon emission of a signal from the sensor and reception of the signal by a game processor, the game processor is configured to execute code and implement a random number generator to send image data to a video display, the image data relating to a randomly selected playing card. The display may (as previously described) be at individual player position terminals. There may also or alternatively be a community display screen showing one or more player selections (e.g., the highest ranking hand made during a round of play at a bank of terminals) and/or the individual capture positions may have associated display systems (by way of non-limiting examples, such available technology such as an LED display screen, a liquid crystal display, fiber optic displays and the like). As each ball triggers a display at a particular capture position, the display shows the playing card randomly selected by the random number generator. The associated display systems and the receptors may be provided on a spinning wheel (similar to a roulette wheel). Small displays, such as LED displays, may be carried with the receptors on the perimeter of the spinning wheel to provide small or miniature images of the playing cards/symbols that can then be read by players as the wheel spins around.

Reference to the Figures will assist in a further understanding of the technology described herein.

FIG. 1 shows a schematic of a gaming system according to technology described and enabled herein. The system has a physical ball suspension system 200 with 65 balls 202 suspended by air pressure in a chamber 204. There is a physical path 205 carrying balls out of the chamber 204. A sensing system 210 is shown, which may read individual balls 202 as they pass from the chamber 204 into a receptor compartment 215 or which reads the balls after they have been deposited and restrained within individual receptors (1-60). Signals 225 relating to the presence of balls in any or each individual receptor (160) is sent to a processor 230 which (e.g., through a random number generator RNG not shown) sends data information relating to a display 240 along information communication path 235. The display 240, in response to the signals identifies individual player poker hand ranks based on the position of balls 202 in selected acceptor positions (1-60).

FIG. 2A shows one example of a continuous frame gaming element acceptor system with an associated information sensing system 220 having individual ball acceptor positions (1-60) with individual ball presence sensors A in each acceptor position.

FIG. 2B shows one example of a series of tube gaming element acceptors 221*a*, 221*b*, 221*c*, 221*d*, 221*e* and 221*f* in a gaming system as in FIG. 1. The individual tubes 221*a*, 221*b*, 221*c*, 221*d*, 221*e* and 221*f* have individual ball presence sensors A in each acceptor position.

Figure 3:
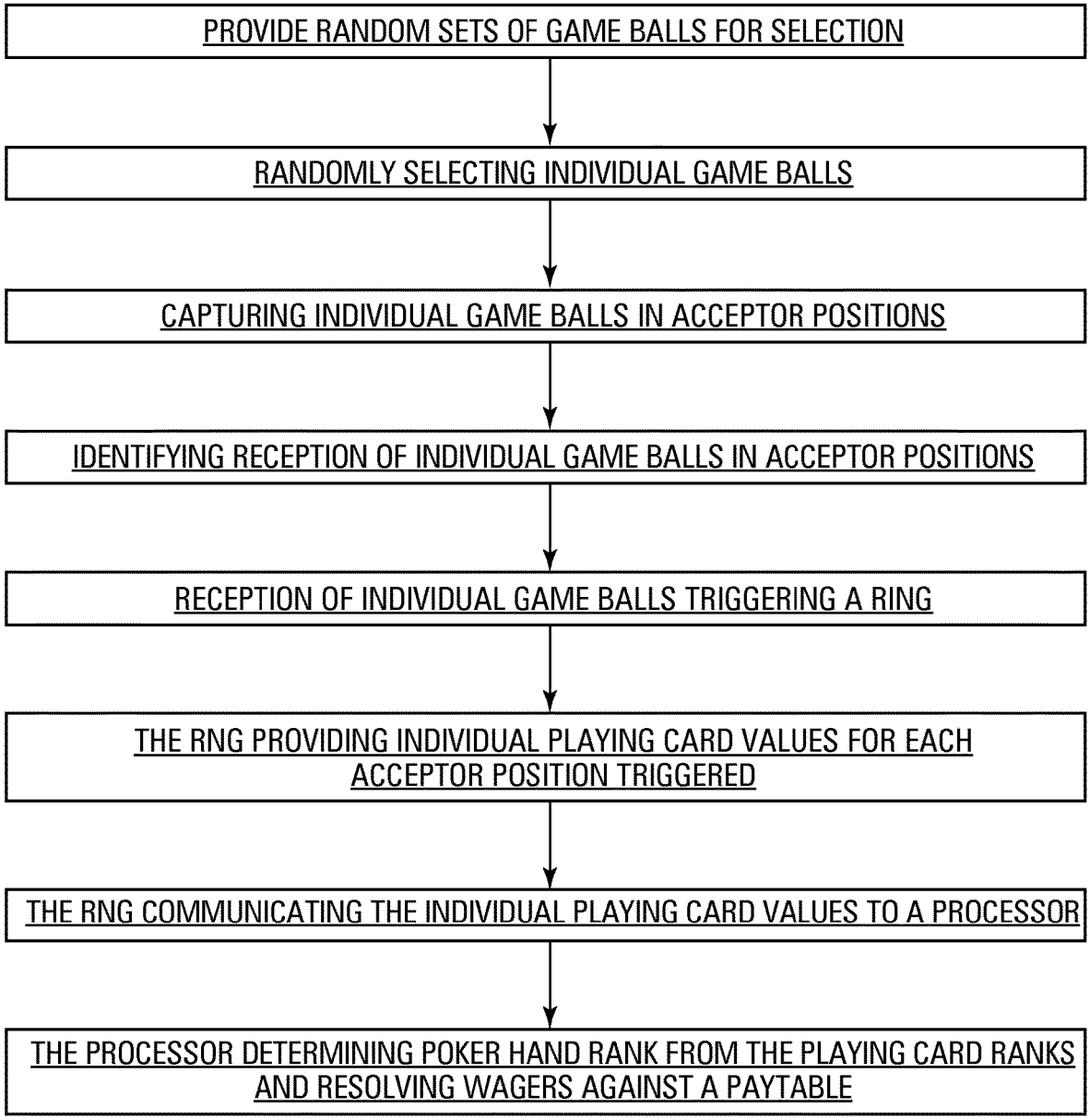
FIG. 3 is a flow diagram of a method of playing a wagering game on a gaming system according to technology described and enabled herein.

FIG. 3 is a flow diagram of one embodiment of a method of playing a wagering game on a gaming system according to technology described and enabled herein.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

A mixed electronic and physical gaming system may also be constructed, with the physical balls having no readable information thereon, but giving the illusion of specific playing card identification content on the individual balls. The plying card information provided can still be provided in an acceptable random and gaming certifiable and provable randomness. The randomness provided may even be of a more acceptable and provable level than would a physical random selection or drop ball system.

An underlying commercially available random number generation system with associated card suits and ranks may be purchased. This type of device, when activated or signaled will randomly select a number (weighted or not) from a selection of available numbers, and the available numbers are associated with specific playing cards (by rank and suit). For example, if a single deck of virtual playing cards (52 with no jokers or bonus cards) is provided by fifty-two random, indistinguishable game balls available for fifty-two receptor slots on the physical gaming system. The capture of a ball or the entrance of a ball into a receptor (as described herein) triggers the random number generator and any available virtual playing card is selected. By remaining card it is meant that as individual cards are removed from the virtual deck, there are fewer cards (the remaining identified card) available for selection. The triggering may be effected in a large number of ways.

The receptors (slots on a wheel, positions on a tube, holes on surface, square or geometrically shaped receiving frames, depressions, troughs or the like) can be associated with a sensor that identifies the presence or passage (past the sensor) of the game ball. The sensor provides the triggering system for the random number generator and the resultant selection of a specific playing card for each ball that is sensed for purposes of providing a playing card result. The sensor provides a signal through mechanical sensing (e.g., a trip wire, a trip toggle, a trip switch, a weight sensor), by optical sensors (e.g., infrared sensors, light interruption sensors, reflected light sensors, and the like), electronic sensors (e.g., RFID sensors, magnetic sensors, static sensors and the like) and any other system that can sense the presence or movement of a ball at a particular position.

Rather than the balls having or requiring a unique identifier that is associated with a playing card, the capture or positioning of the ball triggers the random number generator produces a resulting playing card. As an example, when a ball slides into a random drop slot (as in a roulette wheel), the ball is sensed and the random number generator provides data relating to a specific playing card. That specific playing card (identified to and/or by a processor) can then be displayed to players indicating the provision of that specific playing card to a particular slot or receptor, which may be a part of a wager (including a wager on a poker hand). One unique characteristic of this format is that the random number generation of playing cards is already industry accepted and approved in every gaming jurisdiction. The unique triggering device and random number generator combination provides a gaming system that has a high entertainment value, visual uniqueness and energetic system. There is an expectation as each of the playing cards is revealed as the balls enter the individual receptors.

The display of the playing card (rand and suit) can be provided in a number of ways. For example, each individual player may have a video monitor that shows the set of numbers (e.g., 1-52) and shows the numbers (first subset) selected by the wagers at the terminals, and then show corresponding playing card images for each number where a ball is captured and the random number generator provides a virtual random playing card which the processor is configured to provide signals and data for display. The numbers on the screen may be converted to display playing cards in each position. The system may differentiate playing cards associated with the first subset in a number of ways. As with keno hits, a unique color or image may be provided when the playing card is displayed on a first subset selected number for each player position terminal and monitor. The non-selected playing cards my be black-and-white, a different (less intense) color density and tone, the non-selected cards may be a smaller size than the selected number playing cards. There may also be a separate display area on the individual player monitors that shows collected selected arrays of an individual's playing cards and those cards may also be automatically arranged by the game processor to emphasize quality best player 5-card poker hands after all player number selections have been completed and even indicate potential best possible hands as individual player's position virtual cards are being provided. An example of play of the game is provided below to illustrate this game play format.

A gaming system is provided with a set of fifty-two lightweight (e.g., ping pong) balls. The balls are churned in air and circulated in a display. Individual balls are withdrawn from the set of balls and then individually distributed to and captured by a receptor. As the ball enters the receptor or as it is seated in the receptor, the ball passes over or blocks a sensor such as a proximity detector (e.g., U.S. Pat. No. 6,299,534) an optical detector (light emitter/receiver, transducer). Upon emission of a signal from the sensor and reception of the signal by a game processor, the game processor is configured to execute code and implement a random number generator to send image data to a video display, the image data relating to a randomly selected playing card. The display may (as previously described) be at individual player position terminals. There may also or alternatively be a community display screen showing one or more player selections (e.g., the highest ranking hand made during a round of play at a bank of terminals) and/or the individual capture positions may have associated display systems (by way of non-limiting examples, such available technology such as an LED display screen, a liquid crystal display, fiber optic displays and the like). As each ball triggers a display at a particular capture position, the display shows the playing card randomly selected by the random number generator.

This last format of gaming system may be described as a gaming system having at least:

a set of individually movable gaming elements;

a system for moving multiple gaming objects at the same time;

at least one sensor a) detecting movement of a gaming element towards a receptor system or cessation of movement of a gaming element in a receptor system and b) emitting a signal indicating a randomly selected symbol or number;

a processor configured to receive the signal and execute code to cause a second signal of an image of the indicated symbol or number be transmitted to a display element; and the display element displaying an image of the random symbol or number selection upon emission of the signal indicating a randomly selected symbol or number. The gaming elements comprise lightweight balls, such as sponge balls, porous balls, ping-pong balls and the like. The system for moving the gaming elements may be an air movement system such as a cyclonic or swirling air movement system that supports multiple balls. Where poker game outcomes are being created, there are preferably at least 52 gaming balls. By having more balls, multiple decks may be available, and where, for example, there were five decks, outcomes of an identical five-of-a-kind (e.g., five Aces of Spades) would be an available outcome in a five-card poker game. The gaming system processor may be configured to randomly send signals of images of individual playing cards to a display element. The gaming system may have at least fifty-two individually distinct receptor positions that are configured to receive one ball in each receptor position, such as slots in a roulette-type wheel that will accommodate only single balls in each slot or canoe. The receptor system may be constructed of a passageway(s) where individual balls pass and are sensed as they move through the passageway (s). The sensor may be positioned at an opening to or within a receiving position within the receptor system, whether a slot, a hole, a box, a passageway, or the like. The gaming system may have multiple display elements and each display element is associated with at least one distinct receptor position. The gaming system may have an equal number of balls (there may be more balls than receptor positions for special effects) as receptor positions and a sensor positioned within each distinct receptor position, but where all balls are used, the receptors should have at least as many, if not more, receptor positions than balls. A single receptor structure could be a slot capturing five balls (for example) with the five positions in receptor A being differentiated by the sensor and process as, for example, A-1, A-2, A-3, A-4 and A-5. There may be a single sensor or multiple sensors at the entrance to the passageway or in the passageway. There may be multiple passageways and each passageway may have a sensor at the entrance to the passageway or in the passageway. The gaming system may have the receptors distributed around a spinning wheel, the receptors and displays affixed to the spinning wheel, and there may be individual displays associated with each receptor.

Figure 7:
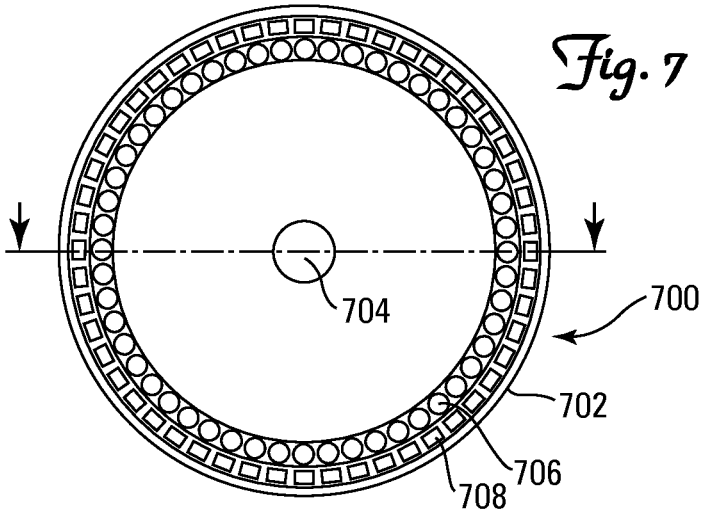
FIG. 7 shows an overhead view of a modified roulette-type wheel useful in the practice of the present technology.

FIG. 7 shows an overhead view of a modified roulette-type wheel 700 useful in the practice of the present technology. The wheel 700 has an outside edge 702 and a central axis 704 which also has an opening therein to allow a ball (not shown) to be automatically ejected out of the hole to be captured in the wheel 700. There are a series of capture holes 706 distributed around the wheel 700 and small individual displays 708 associated with each individual hole 706. The small individual displays may be any format of display, with LEDs or liquid crystal displays, because of their small physical profiles, being preferred.

Figure 8:
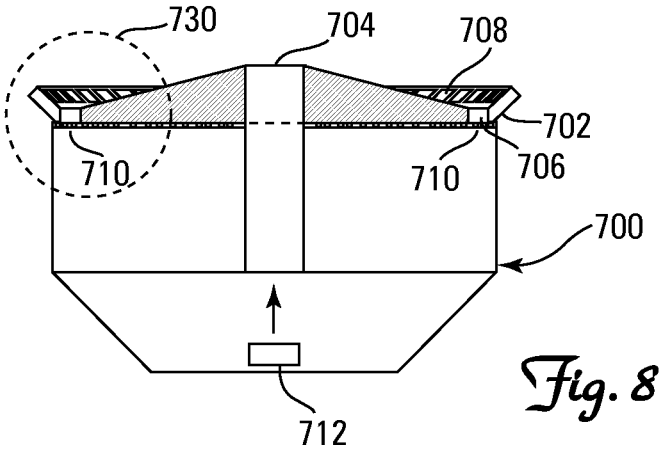
FIG. 8 shows a side cut-away view of a modified roulette-type wheel as in FIG. 7 useful in the practice of the present technology.

FIG. 8 shows a side cut-away view of a modified roulette-type wheel 700 as in FIG. 7 useful in the practice of the present technology. All identical numbers in FIGS. 7 and 8 represent the same components. A fan 712 is shown below the hole in the central axis 704 to power air flow to move balls onto the spinning wheel 700. A section 730 of the wheel is identified to be shown in FIG. 9. Optical readers 710 are shown at the bottom of individual holes 706.

Figure 9:
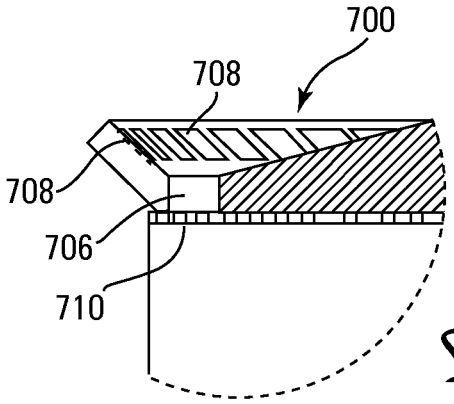
FIG. 9 shows a further side cut-away view of a modified roulette-type wheel as in FIGS. 7 and 8 useful in the practice of the present technology.

FIG. 9 shows a further side cut-away view of a modified roulette-type wheel 700 as in FIGS. 7 and 8 useful in the practice of the present technology. All identical numbers in FIGS. 7, 8 and 9 represent the same components. Optical readers 710 are shown at the bottom of individual holes 706.

Figure 10A:
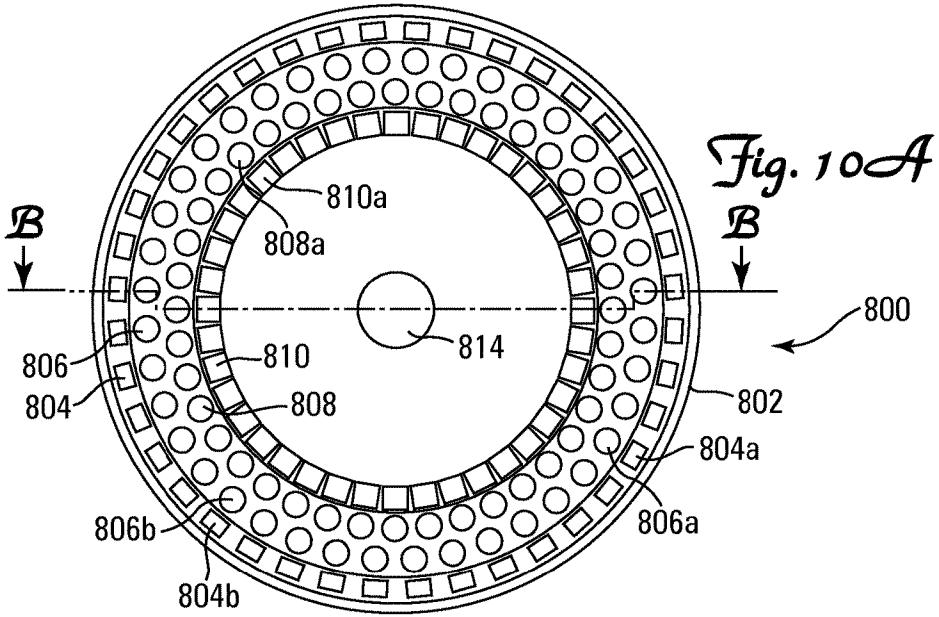
FIG. 10A shows a top view of a different alternative embodiment of a modified roulette-type wheel useful in the practice of the present technology.

FIG. 10A shows a top view of a different alternative embodiment of a modified roulette-type wheel 800 useful in the practice of the present technology. The wheel 800 is shown with an exterior side 802 within which are two sets of ball receptors 806, 808 (here shown as cylindrical holes) and individually associated small display panels 804, 810 (respectively). This larger wheel can accept more balls during different games (e.g., keno), yet enable practice of the underlying games of this technology. There is again a central axis hole 814 within the wheel 800. In this Figure it can be seen that a ball receptor 806*a* has an individual display panel 804*a* and the individual second tier of ball receptors 808, specifically 808*a* has its own individual display panel 810*a*.

Figure 10B:
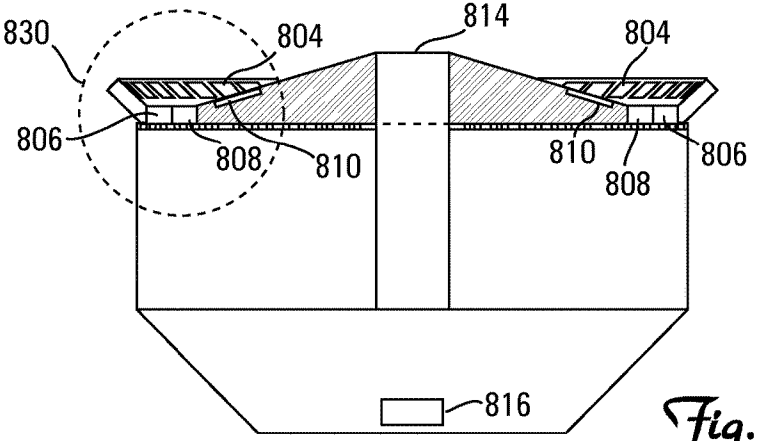
FIG. 10B shows a side cut-away view of a modified roulette-type wheel as in FIG. 10A useful in the practice of the present technology.

FIG. 10B shows a side cut-away view of a modified roulette-type wheel 800 as in FIG. 10A useful in the practice of the present technology. All identical numbers in FIGS. 7 and 8 represent the same components. Also shown in this Figure are a fan 816 to move air to support and/or eject game balls (not shown) and to identify a section 830 of the wheel 800 that will be shown in greater detail in FIG. 10C.

Figure 10C:
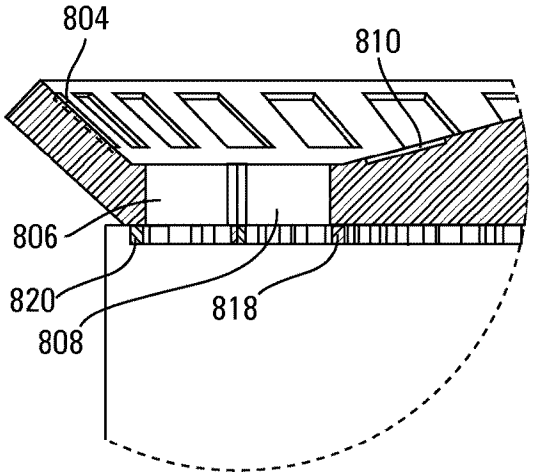
FIG. 10C shows a further side cut-away view of a modified roulette-type wheel as in FIGS. 10A and 10B useful in the practice of the present technology.

FIG. 10C shows a further side cut-away view of a modified roulette-type wheel 800 as in FIGS. 10A and 10B useful in the practice of the present technology. All identical numbers in FIGS. 10A and 10B represent the same components. This Figure also shows optical or mechanical sensors 818, 820 for each individual ball receptor hole 808, 806, respectively. These sensors, as discussed elsewhere in this specification, indicate the presence of any ball or a particular ball within the respective hole. The triggering by the sensors 818, 820 indicates the presence of a ball entering or within the ball receptor 808, 806, respectively, and then initiates gaming activity resulting in the display of a game value on the respective display panels 810, 804. As a non-limiting example, when a ball falls into receptor hole 808, sensor 818 senses the presence of a ball and signals to a processor (not shown). The processor then may execute code to effect random event selection (e.g., generating a random number, and each available number value being further associated with a random symbol outcome, such as a single playing card rank and suit). The result of the random event/random symbol selection is then transmitted as image providing data to the display panel, and that result displayed. The result is also stored on at least temporary memory for use in a game event outcome determination by the processor, as described herein.

Chipless Gaming Table Implementation

One enabling system useful in the practice of the present invention is a system marketed under the name i-TABLE® by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six® shuffler, Ace® shuffler, I-DEAL® shuffler, I-SHOE® delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like.

With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) are known in poker style games.

There is also a game controller, CPU or casino computer whose location at the table system is relatively unimportant, but which must be in direct (hardwired or wireless or networked) communication with each individual player processor, a card reading and/or delivery system, and a dealer input In a preferred form of the invention, the game controller resides beneath the gaming table surface within a layer of the gaming table top structure. Layered gaming table tops enable the system to house all of the necessary electronics yet rest on a standard set of table legs and appear very similar to a standard gaming table to the untrained eye.

An electronic player display (not shown) may be mounted on a pole and supported by pole support. The player display (not shown) may be a double-sided table sign. The side opposite the side viewable by the player is viewable by pit personnel. The player display is also in communication with game controller and may provide information on the specific game being offered, historical player game results, game outcome trends, game rules, game play advice, advertisements and a variety of other information useful or entertaining for players.

Dealer display includes data input capability and may be used by the dealer to input "buy in" amounts, to confirm game play results, to provide the dealer with game play instructions such as instructions on how to set the highest ranking hand, and the like. A random number generator may be included as part of the processing capability of the dealer display and be used to determine which player receives a first hand, what data on wagers is input at player positions, or for other purposes. In an alternate embodiment, the dealer display resides on the table or as a separate keypad (not shown).

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

An exemplary chipless table system is disclosed in co-pending U.S. application Ser. No. 12/218,583, filed Jul. 15, 2008 and U.S. application Ser. No. 12/231,759, filed Sep. 5, 2008 which are herein incorporated by reference in the entireties.

Multi Player Platform Implementation

Figure 4:
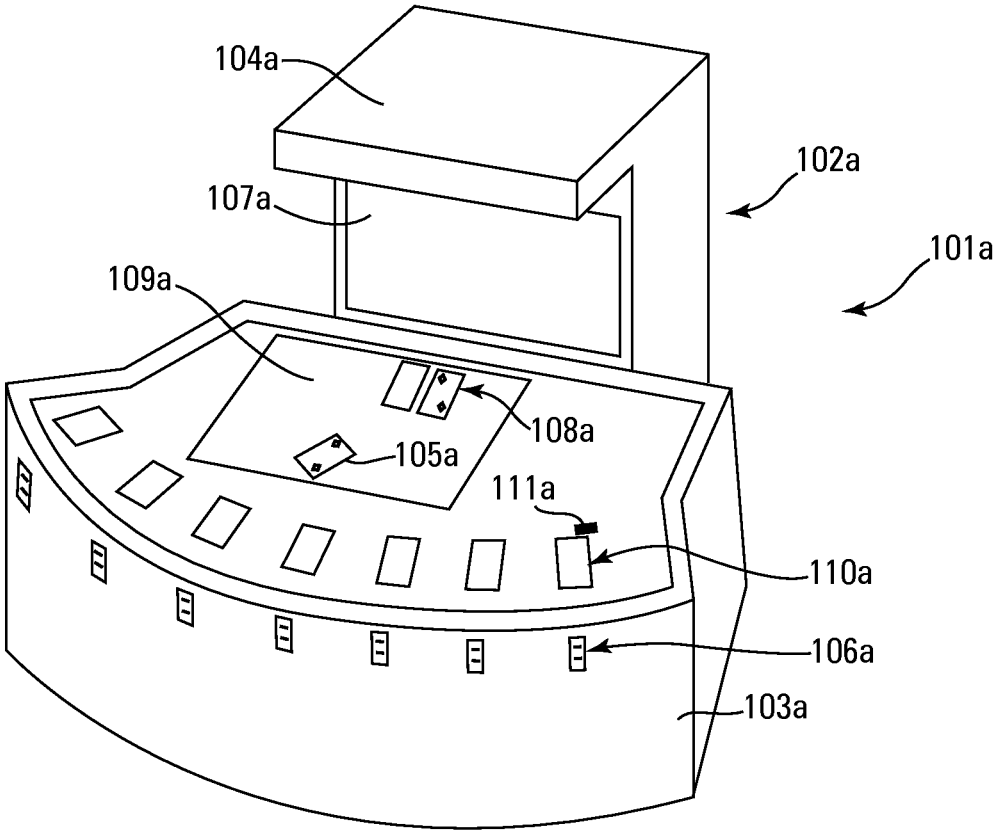
FIG. 4 shows an example of an automated table system 101*a* useful to practice the game play methods of the present invention. This system is fully disclosed in U.S. Patent Publication 2005/0164759 A1.

FIG. 4 shows an example of an automated table system 101*a* useful to practice the game play methods of the present invention. This system is fully disclosed in U.S. Patent Publication 2005/0164759 A1. The content of this application is incorporated by reference in its entirety. The system 140 has an upright dealer display cabinet 142 with a top 144 and a virtual dealer viewing screen 146 which may be any form of display screen such as a CRT, plasma screen, liquid crystal screen, LED screen or the like. The common player area has a common player display screen 148 on which images of cards being dealt 150, bets wagered (not shown) and touch screen player input controls 152 are located. Other player input functions may be provided on a panel 154 which might accept currency, coins, tokens, identification cards, player tracking cards, ticket in/ticket out acceptance, and the like.

Figure 5:
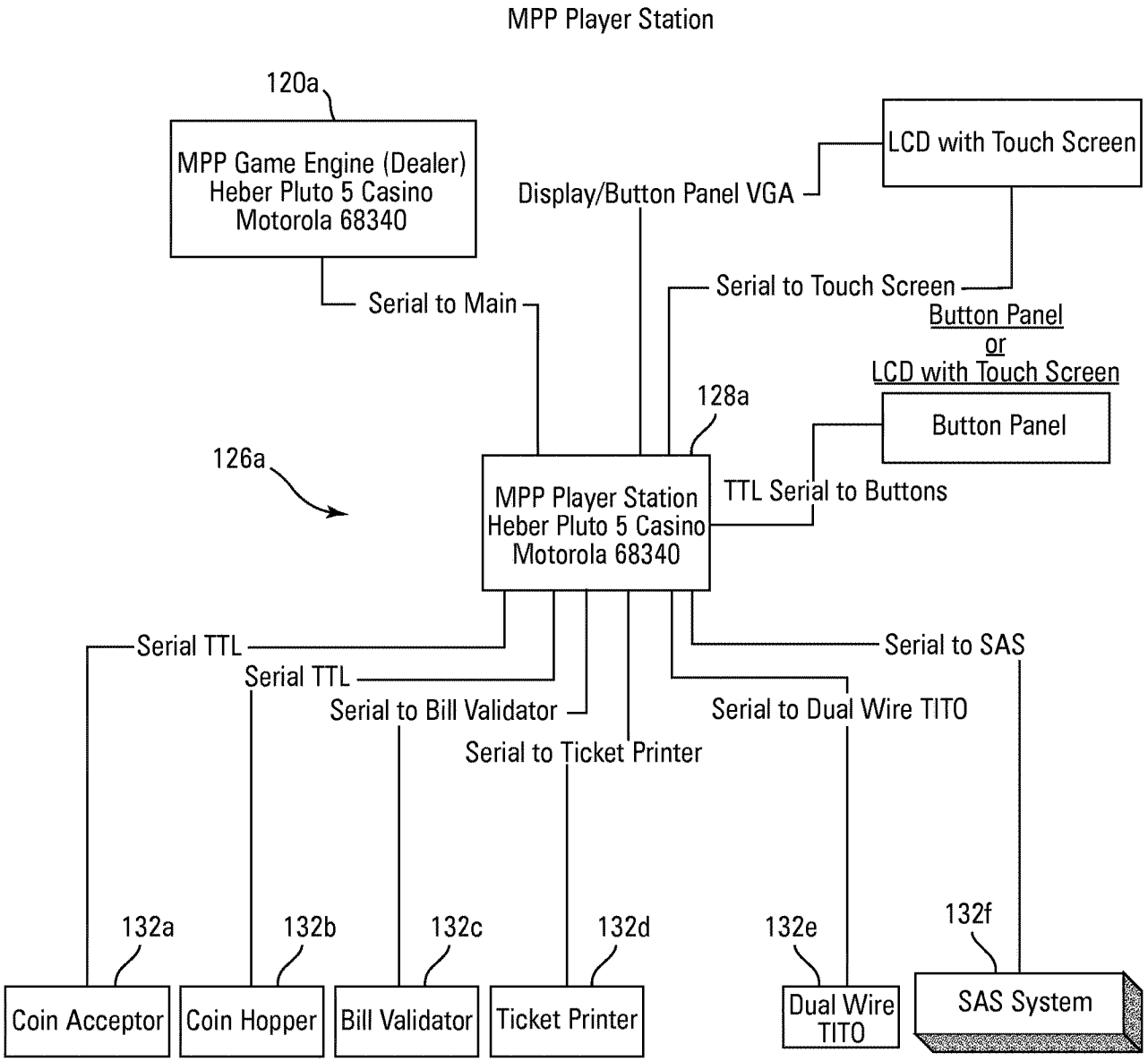
FIG. 5 shows an electronic/processor schematic for a MultiPlayer Platform (MPP) gaming system.

FIG. 5 shows an electronic/processor schematic for a MultiPlayer Platform (MPP) gaming system. The MPP Game engine (dealer) comprises a Heber Pluto 5 casino game board 200 (Motorola 68340 board) operating off the PC Platform Pentium™ 4 MPP Game Display processor 202. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

Figure 6:
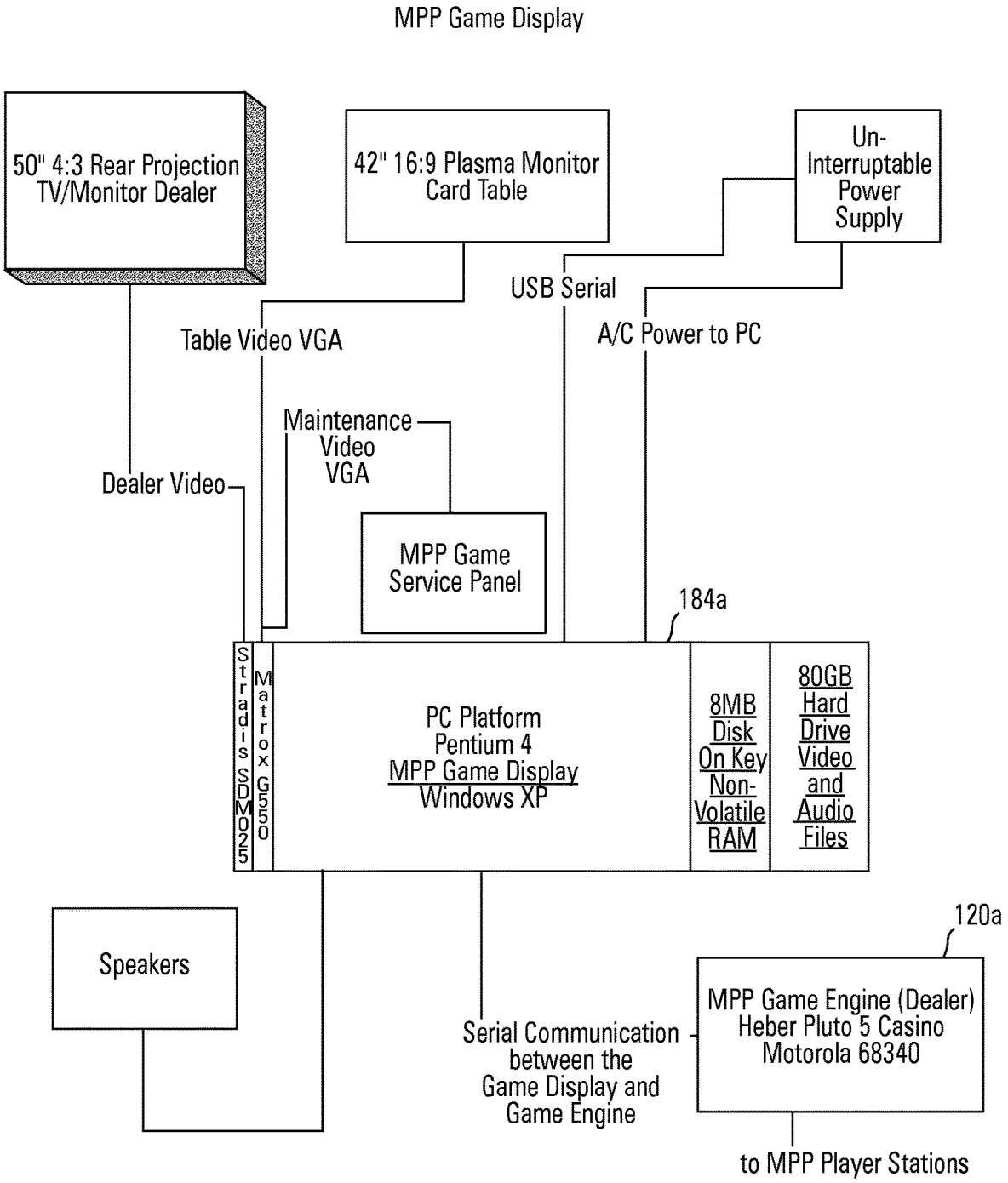
FIG. 6 shows the electronic/processing schematics of the MPP Player Station according to FIG. 5.

FIG. 6 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform (not shown in this Figure). Each Intelligence board receives information for all player input systems specific to that player station, such as the shown Coin Acceptor, Coin Hopper, Bill Validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed. With the player intelligent boards, the main game PC can receive packets of information from each player station as events occur rather than having to poll each player position on a regular basis 100 times to gain the specific information for each player input that may be made. The following is a discussion of exemplary hardware components that can be used in a multi-player gaming platform that enables play of games of the present invention.

Heber Board

A description of the Heber Board, (an exemplary board that can be used as a player station processor and/or game engine processor) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars™ coin/note acceptors or the ccTalk format for Money Controls™ hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium-level to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013.

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0x16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. For example, the main game engine may have rules and commands that will enable play of high and low games of the present invention and other card games. The system may be controlled so that different games may be played at different times on command of the casino or players.

The gaming technology described and enabled herein may also be incorporated into internet gaming systems in any number of protocols. Actual physical ball drops images may be captured by camera, animated simulated ball drops may be displayed, and a gaming processor acknowledges wagers transmitted over the internet and resolves the wagers based upon physical outcomes or the virtual outcomes determined by a random number generator and simulated by animation or recorded images. As with any wagering system using electronic wagering and electronic resolution (processor or microprocessor controlled), the processor must be configured to execute code to resolve the wagers, conduct bookkeeping functions, compare achieved poker hands against paytables, differentiate some wagers and wagering conditions from others (e.g., recognizing differences among 5, 6, 7, 8, 9 or 10 numbers in a subset).

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth™, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on the Intel® Pentium® or Centrino™ processor, that are adapted to communicate with the computer. Any number and type of devices may be in communication with the computer.

In some embodiments, a server computer and one or more client computers may perform desired actions. Actions may be performed by one or more of the clients and/or servers in accordance with a desired distribution of labor. Such distribution of labor may be made based on where the actions may be performed more securely, more quickly, and/or more cost-effectively. For example, in some implementations, complex calculations may be performed by a central server to increase speed, display related calculations may be performed by a client because they may be simple, outcome determining calculations may be performed by a central server in order to ensure the validity of the calculations and allow tweaking of odds to be performed at a single location. It should be recognized that any desired actions may be divided among a server and any number of clients in any desired way.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human).

In one embodiment, the gaming device preferably includes at least one processor, such as a microprocessor, a microcontroller-based platform, a suitable integrated circuit or one or more application-specific integrated circuits (ASIC's). The processor is in communication with or operable to access or to exchange signals with at least one data storage or memory device. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one alternative embodiment within the generic scope of the invention, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one further embodiment, the gaming device includes one or more display devices controlled by the processor. The display devices are preferably connected to or mounted to the cabinet of the gaming device. The embodiment may include a central display device 16 which displays a primary game. This display device may also display any suitable secondary game associated with the primary game as well as information relating to the primary or secondary game. The upper display device may display the primary game, any suitable secondary game associated or not associated with the primary game and/or information relating to the primary or secondary game. These display devices may also serve as one embodiment, the gaming device includes a credit display which displays a player's current number of credits, cash, account balance or the equivalent. In one embodiment. The gaming device includes a bet display which displays a player's amount wagered. In one embodiment, as described in more detail below, the gaming device includes a player tracking display which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, the display device includes a touch-screen with an associated touch-screen controller. The display devices may be of any suitable size and configuration, such as a square, a rectangle or an elongated rectangle.

The general scope of the invention may include methods and systems as follows. A method of playing a wagering game on an electronic gaming system may have, for example:

a) a central processor;
b) a video display system;
c) data entry systems in communication with the central processor;
d) an electronic random number generator in communication with the central processor; and
e) memory containing look-up tables of event result tables;

The event outcome is determined by the processor executing code to compare the virtual gaming event outcome from the randomly generated virtual events that are displayed on the screen. casting of the virtual balls and the event results table. The processor displays at least one of the event result tables on the video display system and indicates virtual game piece movement on a virtual playing field as a result of comparing the random event of the virtual casting of the three virtual dice with the event result tables or paytables to determine wagering or game events from the random event. The data entry systems are selected from the group consisting of hand-held wireless communication devices, networked television systems, keypads, stand-alone wagering terminals, personal computers on a network or internet and banks of wagering terminals. A gaming system for playing the wagering game may have, as described in greater detail above:

a) a central processor;
b) a video display system;
c) data entry systems in communication with the central processor;
d) an electronic random number generator in communication with the central processor; and memory containing look-up tables of event result tables.

The scope of the invention shown in the above examples and descriptions are intended to be only specific, non-limiting examples and descriptions of the generic concepts claimed herein. All references cited herein are incorporated herein by reference in their entirety.

The invention claimed is:

1. A gaming system, comprising:

a first set of individually movable gaming elements physically retained in a first area, each movable gaming element including no visible indications and including machine-readable indicia indicative of at least one of a number and a symbol associated with the movable gaming element;

a roulette-type wheel comprising at least two tiers of individually distinct receptors positioned around a central axis, and a display panel for each receptor position indicating a presence of a gaming element wherein each receptor position is configured to capture one movable gaming element of the one or more movable gaming elements;

a system for randomly moving one or more movable gaming elements of the first set in the first area to a second area, the second area including the individually distinct receptor positions on the roulette-type wheel;

at least one sensor configured to detect each movable gaming element entering or within the second area;

a processor configured to:

execute code to sense the number or symbol associated with the machine-readable indicia on each detected movable gaming element, cause a randomly selected number or symbol to be associated with each detected movable gaming element based on the sensed numbers or symbols, and communicate one or more of the randomly selected numbers or symbols to a video display, determine an outcome for a gaming event, based on the randomly selected number or symbol associated with each detected movable gaming element, resolve at least one wager received from a playing terminal, based on the outcome for the gaming event; and wherein the video display is configured to display an image of each randomly selected number or symbol associated with each detected movable gaming element, and the resolution of the at least one wager.

2. The gaming system of claim 1, wherein the movable gaming elements comprise lightweight balls.

3. The gaming system of claim 2, wherein the system for moving the one or more movable gaming elements comprises an air movement system.

4. The gaming system of claim 3, wherein the air movement system is configured to support or inject multiple balls into a chamber.

5. The gaming system of claim 2, wherein the system for moving the one or more movable gaming elements comprises a spinning wheel.

6. The gaming system of claim 2, wherein the second area includes four or more tubes and each individually distinct receptor position corresponds to a position with each tube among the four or more tubes.

7. The gaming system of claim 1, wherein there are at least 52 movable gaming elements and wherein each number or symbol represents a different rank and suit corresponding to a playing card in a playing card game.

8. The gaming system of claim 7, wherein the image of each randomly selected number or symbol corresponds to at least 6 individual playing cards.

9. The gaming system of claim 1, wherein there are at least fifty-two movable gaming elements in the first area and at least fifty-two individually distinct receptor positions in the second area.

10. The gaming system of claim 1, wherein the at least one sensor is configured to detect each movable gaming element as each movable gaming element enters a passageway between the first area and the second area.

11. The gaming system of claim 1, wherein the at least one sensor is configured to detect each movable gaming element as each movable gaming element enters the second area.

12. The gaming system of claim 1, wherein the at least one sensor is configured to detect each movable gaming element upon being captured by an individually distinct receptor position.

13. The gaming system of claim 1, wherein the display includes multiple display elements and each display element is associated with at least one individually distinct receptor position.

14. The gaming system of claim 13, wherein the system for moving the one or more movable gaming elements comprises a spinning wheel, and wherein the individually distinct receptor positions and the display elements are distributed around the spinning wheel.

15. The gaming system of claim 1, wherein one sensor among the at least one sensor corresponds to each individually distinct receptor position.

16. The gaming system of claim 15, wherein there is an equal number of movable gaming elements to the individually distinct receptor positions.

17. A method of operating a gaming system, comprising:

providing a first set of individually movable gaming elements in a first area, each movable gaming element including no visible indications and including machine-readable indicia indicative of at least one of a number and a symbol associated with the movable gaming element;

randomly moving one or more movable gaming elements of the first set in the first area to a second area on a roulette-type wheel, wherein the roulette-type wheel comprises at least two tiers of individually distinct receptors positioned around a central axis, the second area includes the individually distinct receptor positions, and each receptor position is configured to capture one movable gaming element of the one or more movable gaming elements;

detecting each of the one or more movable gaming element entering or within the second area;

sensing a number or symbol associated with each detected movable gaming element, based on the machine-readable indicia;

associating a randomly selected number or symbol with each detected movable gaming element;

determining an outcome for a gaming event, based on the randomly selected number or symbol associated with each detected movable gaming element;

resolving at least one wager received from a playing terminal, based on the outcome for the gaming event;

communicating one or more of the randomly selected numbers or symbols to a display; and displaying an image of each randomly selected number or symbol communicated to the display, and the resolution of the at least one wager.

18. The method of claim 17, further comprising:

capturing each of the one or more movable gaming elements in an individually distinct receptor position in the second area.

19. The method of claim 17, wherein the first set includes at least fifty-two movable gaming elements and wherein each image corresponds to a different rank and suit for a playing card.

20. The method of claim 19, wherein displaying includes displaying the image as a playing card hand for each of at least one player and a dealer or at least two players.

21. The method of claim 20, wherein the playing card hand is a poker hand.

* * * * *